US011377951B2

(12) United States Patent
Tan et al.

(10) Patent No.: US 11,377,951 B2
(45) Date of Patent: Jul. 5, 2022

(54) INTELLIGENT WATER INVASION TRACKING AND EARLY WARNING METHOD FOR WATER-GAS RESERVOIRS

(71) Applicant: Southwest Petroleum University, Sichuan (CN)

(72) Inventors: Xiaohua Tan, Sichuan (CN); Xiaobing Han, Sichuan (CN); Xiaoping Li, Sichuan (CN); Mingqing Kui, Sichuan (CN); Zhenglin Mao, Sichuan (CN); Guojun Yang, Sichuan (CN); Hao Yang, Sichuan (CN)

(73) Assignee: Southwest Petroleum University, Sichuan (CN)

( * ) Notice: Subject to any disclaimer, the term of this patent is extended or adjusted under 35 U.S.C. 154(b) by 0 days.

(21) Appl. No.: 17/482,429

(22) Filed: Sep. 23, 2021

(65) Prior Publication Data

US 2022/0010674 A1 Jan. 13, 2022

(30) Foreign Application Priority Data

Sep. 24, 2020 (CN) ..... 202011017397.7

(51) Int. Cl.
*E21B 47/10* (2012.01)
*E21B 47/06* (2012.01)

(52) U.S. Cl.
CPC ..... *E21B 47/10* (2013.01); *E21B 47/06* (2013.01); *E21B 2200/20* (2020.05)

(58) Field of Classification Search
CPC ..... E21B 47/10; E21B 47/06; E21B 2200/20
See application file for complete search history.

(56) References Cited

U.S. PATENT DOCUMENTS

2009/0294122 A1* 12/2009 Hansen ..... E21B 43/00 166/305.1
2022/0019718 A1* 1/2022 AlSaud ..... E21B 43/20

* cited by examiner

*Primary Examiner* — Yoshihisa Ishizuka

(57) ABSTRACT

An intelligent water invasion tracking and early warning method for water-gas reservoirs includes based on the gas-water two-phase seepage equation, obtaining the water invasion constant and the water flooding index by combining the gas-water two-phase permeability expression with the water invasion material balance method, fitting by automatic fitting method, finding a best fitting between an optimal theoretical value and an actual value, dividing a block into different water invasion areas based on the water flooding index, revising a water invasion classification boundary based on production dynamic monitoring and well logging interpretation results, and tracking and early warning water invasion by drawing a water flooding index distribution map of water-gas reservoirs according to the water flooding index. The present invention solves the problem of no method for tracking and predicting the water invasion direction and the water invasion intensity in real time.

2 Claims, 5 Drawing Sheets

INTELLIGENT WATER INVASION TRACKING AND EARLY WARNING METHOD FOR WATER-GAS RESERVOIRS

CROSS REFERENCE OF RELATED APPLICATION

The present invention claims priority under 35 U.S.C. 119(a-d) to CN 202011017397.7, filed Sep. 24, 2020.

BACKGROUND OF THE PRESENT INVENTION

Field of Invention

The present invention relates to an intelligent water invasion tracking and early warning method for water-gas reservoirs, which belongs to the field of drainage and gas recovery for water-gas reservoirs.

Description of Related Arts

In the development of water drive gas reservoirs, the water producing of gas wells due to the invasion of edge and bottom water will not only increase the difficulty of development and exploitation of gas reservoirs, but also cause the loss of gas well productivity, which reduces the recovery ratio of gas reservoirs and affects the development efficiency of gas reservoirs. Accurate judgment of water invasion dynamics, especially early water invasion identification, is the basis for active and effective development of gas reservoirs. Based on different principles, the current identification methods mainly are gas well production water analysis, pressure drop curve identification and well test monitoring identification. The present invention systematically describes the identification principles, applicable conditions and existing problems of these methods, and points out the methods for effectively identifying water invasion in gas reservoirs.

Water invasion identification of gas reservoirs is an important part of accurate evaluation and efficient development of water drive gas reservoirs. The water sample monitoring and water production analysis method is only applicable after the gas well produces water. The pressure drop curve analysis method is the most commonly used method, but this method has a great risk in the early identification of water invasion, which is only applicable after the curve section of the pressure drop circle appears. The well test analysis method is based on production data and dynamic monitoring data. Due to the complexity of gas reservoirs, in order to reduce the risk of identification, it is necessary to combine dynamic with static information, combine with geological data, and integrate the most water invasion information for early water invasion identification in gas reservoirs.

Generally speaking, the current water invasion identification method generally comprises qualitatively identifying whether the water invasion appears in gas reservoirs or not, and calculating the water influx through the water influx calculation method. There is no real-time method to track and predict the direction and the intensity of water invasion.

SUMMARY OF THE PRESENT INVENTION

An object of the present invention is to solve the problem of no method for tracking and predicting the water invasion direction and the water invasion intensity in real time. The present invention is based on the gas-water two-phase seepage equation, combines the gas-water two-phase permeability expression with the water invasion material balance method for obtaining the water invasion constant and the water flooding index, so as to track and early warning the water invasion direction and the water invasion intensity in real time. The present invention is good in fitting effect and strong in generalizability.

To achieve the above object, the present invention provides an intelligent water invasion tracking and early warning method for water-gas reservoirs. The method comprises steps of:

(A) deriving a material balance equation which considers water-sealed gas phenomenon, which comprises:

(A1) establishing a physical model of the water-gas reservoirs which considers the water-sealed gas phenomenon;

(A2) calculating an invasive water quantity in a high permeability area, an invasive water quantity in a low permeability area, a total invasive water quantity, a sealing water quantity, and a sealed gas volume respectively by formulas (1) to (5) of $$W_H = \frac{A_H K_H}{\mu}\frac{\Delta p}{\Delta L} \tag{1}$$

$$W_L = \frac{A_L K_L}{\mu}\frac{\Delta p}{\Delta L} \tag{2}$$

$$W_e = \omega G B_{gi} = R^B G B_{gi} \tag{3}$$

$$W_b = W_e \frac{W_H}{W_H + W_L} = W_e \frac{V^+ K^+}{V^+ K^+ + 1} \tag{4}$$

$$G_b = \frac{W_b}{V^+ B_{gi}} = W_e \frac{V^+ K^+}{V^+ B_{gi}(V^+ K^+ + 1)}, \tag{5}$$

wherein $W_H$ is the invasive water quantity in the high permeability area, $A_H$ is cross-sectional area of the high permeability area, $K_H$ is permeability of the high permeability area, μ is gas viscosity, Δp/ΔL is pressure drop per unit length, $W_L$ is the invasive water quantity in the low permeability area, $A_L$ is cross-sectional area of the low permeability area, $K_L$ is permeability of the low permeability area, $W_e$ is the total invasive water quantity, ω is storativity ratio, G is single well controlled reserves, $B_{gi}$ is original gas volume coefficient, R is recovery percent of reserves, B is water invasion constant, $W_b$ is sealing water quantity, $V^+$ is dimensionless volume ratio, $K^+$ is dimensionless permeability ratio, $G_b$ is sealed gas volume; and (A3) substituting the formulas (1) to (5) in the step (A2) into a material balance equation expressed by a formula (6) to obtain the material balance equation considering the water-sealed gas phenomenon expressed by a formula (7), wherein the formulas (6) and (7) are respectively $$GB_{gi} = (G - G_p - G_b)B_g + W_e \tag{6}$$

$$\frac{p/Z}{p_i/Z_i} = \frac{1 - R - AR^B}{1 - R^B}, \tag{7}$$

wherein $$B_{gi} = p_{sc} Z_i T / p_i T_{sc}, \quad B_g = p_{sc} Z T / p T_{sc}, \quad R = G_p / G,$$

-continued $$A = \left(\frac{V^+K^+}{V^+K^+ + 1}\right)\frac{1}{V^+}, \quad V^+ = \frac{V_H}{V_L}, \quad K^+ = \frac{K_H}{K_L},$$

here, $G_p$ is cumulative gas production, $B_g$ is gas volume coefficient, Z is deviation factor, $Z_i$ is original deviation factor, p is formation pressure, $p_i$ is original formation pressure, A is reservoir heterogeneity coefficient, $p_{sc}$ is standard pressure and equal to 0.1013 MPa, $T_{sc}$ is standard temperature and equal to 293.15 K, T is temperature;

(B) based on the material balance equation considering the water-sealed gas phenomenon and a gas well productivity equation, fitting by automatic fitting method, wherein the gas well productivity equation is $p^2-p_{wf}^2=Cq_{sc}+Dq_{sc}^2$, here, p is formation pressure, $p_{wf}$ is flowing bottomhole pressure, $q_{sc}$ is gas well production per day, C is laminar coefficient, D is turbulent coefficient, target parameters of the fitting are the reservoir heterogeneity coefficient A, the water invasion constant B, the laminar coefficient C, the turbulent coefficient D and the single well controlled reserves G, the fitting comprises:

(B1) calculating the flowing bottomhole pressure $p_{wf}$ through a wellhead pressure of a production gas well;

(B2) providing upper and lower limits of the target parameters, randomly selecting an initial value within the upper and lower limits, expanding a range defined by the upper and lower limits if a calculation result corresponding to the initial value is out of the range by assigning the calculation result to the upper and lower limits, recalculating till the convergence conditions are met, and calculating the gas well production per day $q_{sc}$ based on the formation pressure p, the flowing bottomhole pressure $p_{wf}$, an initial value of the laminar coefficient C and an initial value of the turbulent coefficient D by the gas well productivity equation;

(B3) obtaining the cumulative gas production $G_p$ by superimposing the gas well production per day $q_{sc}$, and calculating a formation pressure p for a next iteration cycle based on the cumulative gas production $G_p$, an initial formation pressure, an initial value of the reservoir heterogeneity coefficient A, an initial value of the water invasion constant B and an initial value of the single well controlled reserves G by the material balance equation considering the water-sealed gas phenomenon; and (B4) continuing iteration from the step (B1) through the formation pressure p obtained by the step (B3), wherein one day in production data is an iteration cycle, obtaining the flowing bottomhole pressure, water production and the water invasion constant B during an entire production stage, adjusting parameters in the upper and lower limits, fitting the flowing bottomhole pressure and the water production by automatic fitting method, finding a best fitting between an optimal theoretical value and an actual value of the flowing bottomhole pressure and the water production, wherein a convergence condition for water production fitting is expressed by a formula of $$E = \sum_{i=1} [q_{wei}(A, B, C, D, G) - q_{wei}]^2 \leq 0.0001, \tag{8}$$

here, E is deviation, $q_{wci}$ (A, B, C, D, G) is the optimal theoretical value of the water production, $q_{wci}$ is the actual value of the water production; and (C) converting the water invasion constant into a water flooding index by a formula of $$I_w = \frac{(G_p/G)^B GB_g + W_pB_w}{G_pB_g + W_pB_w}, \tag{9}$$

wherein $I_w$ is the water flooding index, $W_p$ is cumulative water production;

revising a water invasion classification boundary, and then dividing a block into a non-water invasion area, a weak water invasion area and a strong water invasion area according to a revised water flooding index interval; and based on the non-water invasion area, the weak water invasion area and the strong water invasion area, performing a water invasion degree judgment on the water flooding index, thereby achieving tracking and early warning water invasion.

Preferably, the step (B1) of calculating the flowing bottomhole pressure through the wellhead pressure of the production gas well is to calculate the flowing bottomhole pressure through an actual gas production, an actual water production and an actual wellhead oil pressure of a gas well, wherein when a ratio of the actual gas production to the actual water production is larger than $10\times10^4$, the flowing bottomhole pressure is calculated by a quasi-single-phase wellbore flow model, when the ratio is smaller than or equal to $10\times10^4$, the flowing bottomhole pressure is calculated by a two-phase wellbore flow model.

Preferably, in the step (C), the non-water invasion area means the water flooding index is in a range of 0 to 0.05, the weak water invasion area means the water flooding index is in a range of 0.05 to 0.3, and a strong water invasion area means the water flooding index is in a range of 0.3 to 1.0.

Compared with prior arts, the present invention has some beneficial effects as follows.

(1) Because the automatic fitting method is used for fitting, the fitting effect of the present invention is better.

(2) The present invention realizes water invasion tracking and early warning through programming, saving time and effort.

(3) The present invention has strong generalizability.

DETAILED DESCRIPTION OF THE PREFERRED EMBODIMENT

The present invention is further explained in combination with embodiments and drawings as follows.

Figure 1:
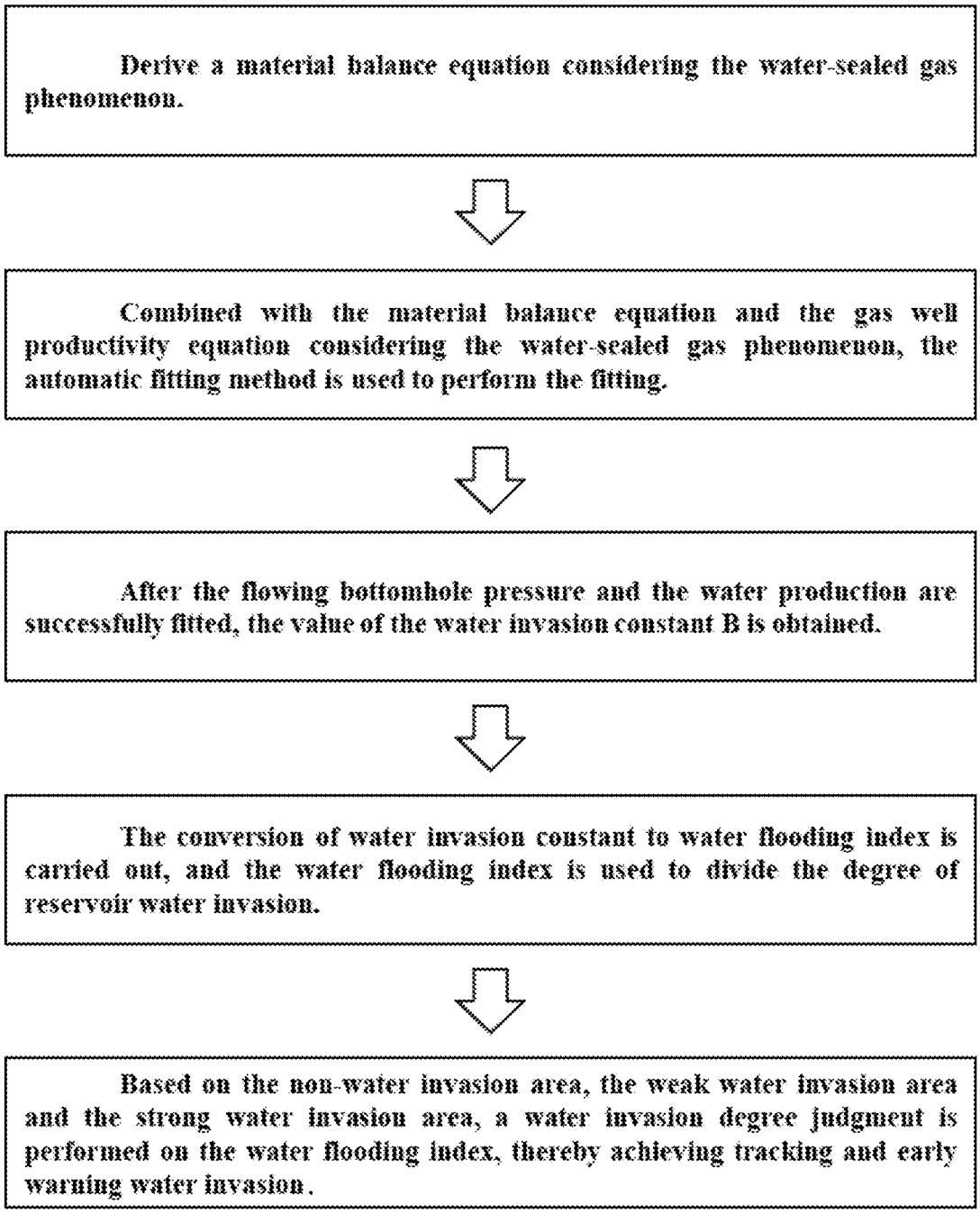
FIG. 1 is a flow chart of an intelligent water invasion tracking and early warning method for water-gas reservoirs provided by the present invention.
Figure 2:
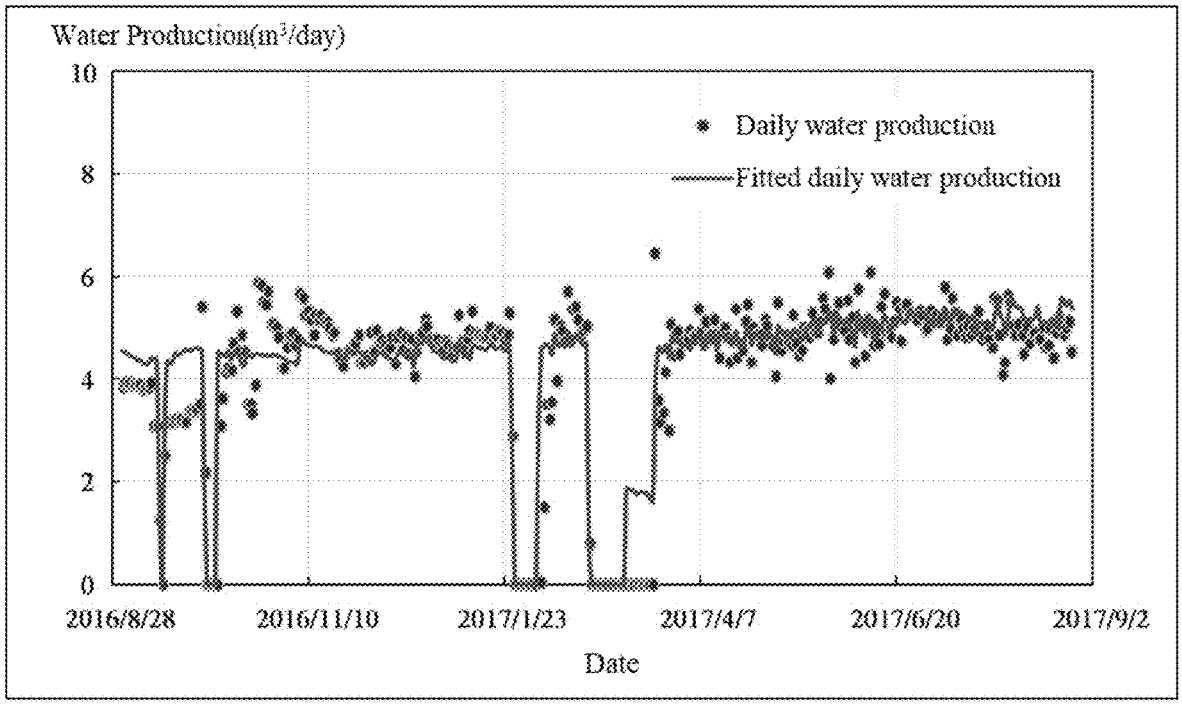
FIG. 2 is a fitting diagram of water production of a well.
Figure 3:
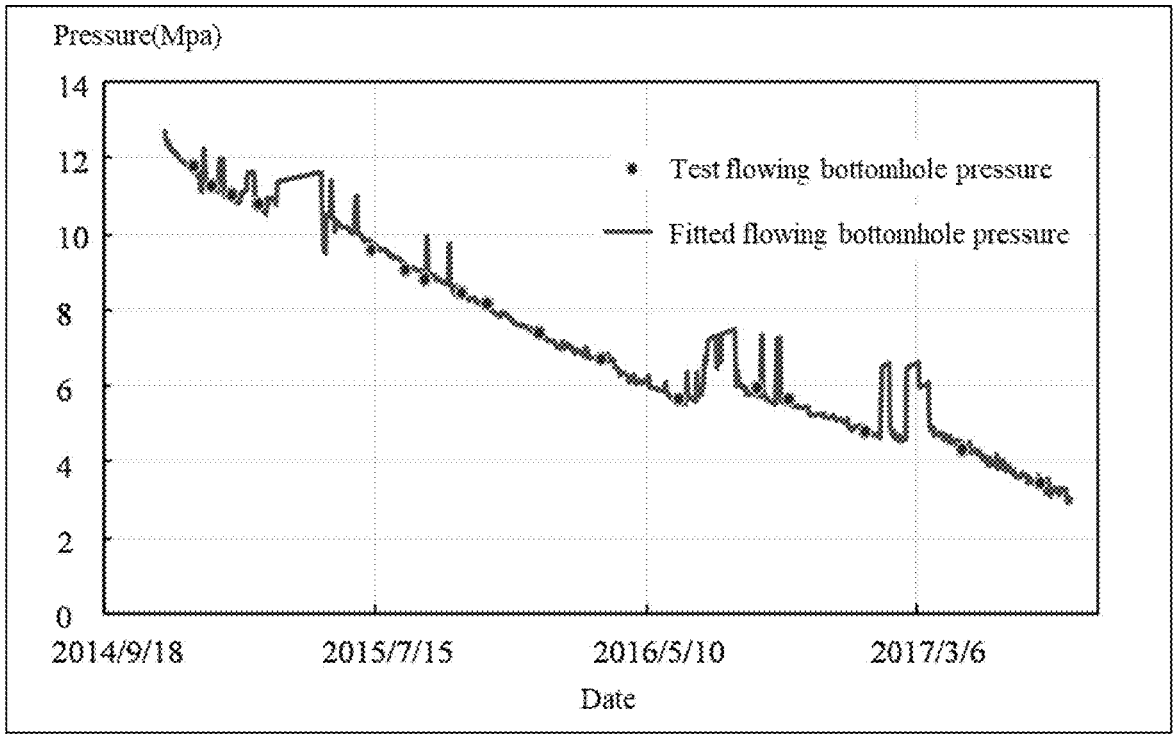
FIG. 3 is a fitting diagram of flowing bottomhole pressure of a well.
Figure 4:
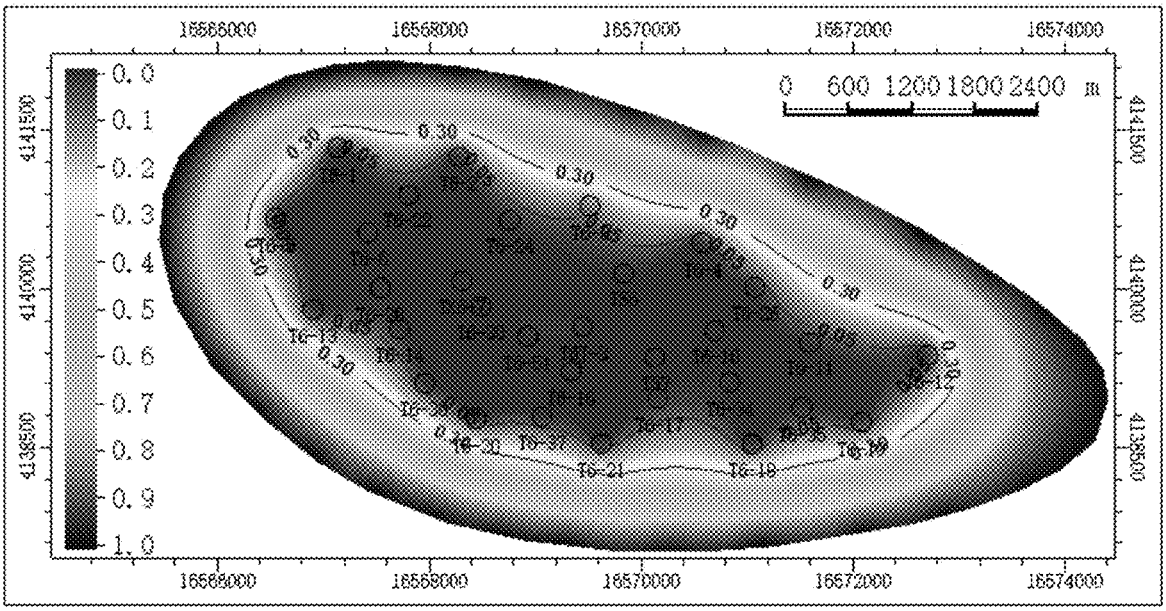
FIG. 4 is a water invasion tracking map of a certain block in 2010.
Figure 5:
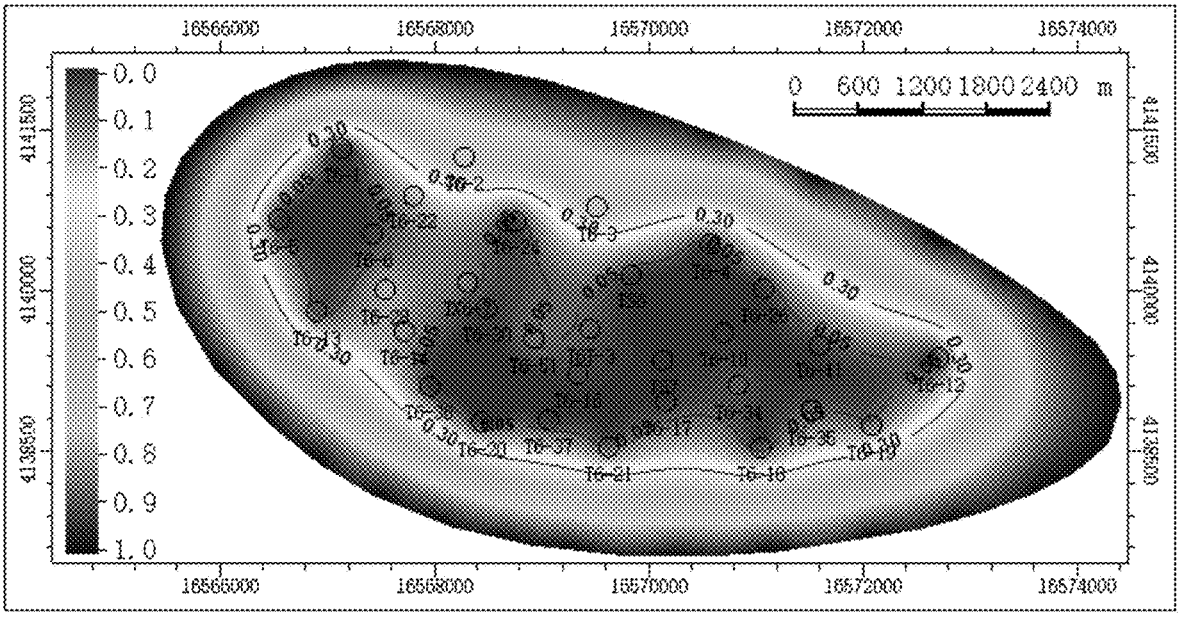
FIG. 5 is a water invasion tracking map of a certain block in 2020.
Figure 6:
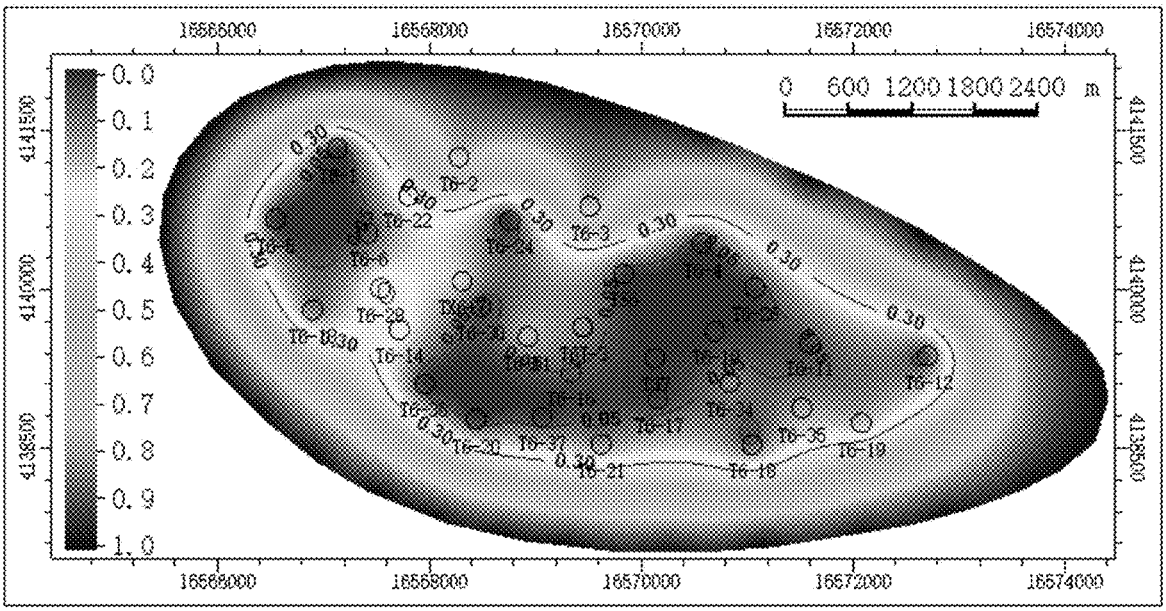
FIG. 6 is a water invasion tracking map of a certain block in 2030.
Figure 7:
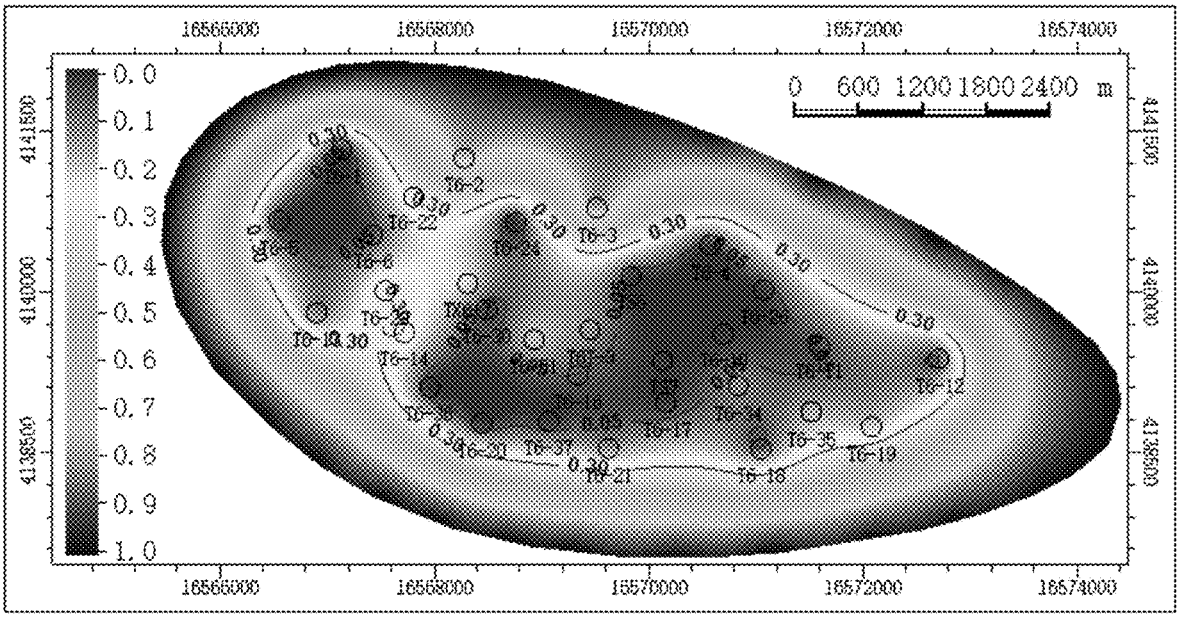
FIG. 7 is a water invasion tracking map of a certain block in 2040.
Figure 8:
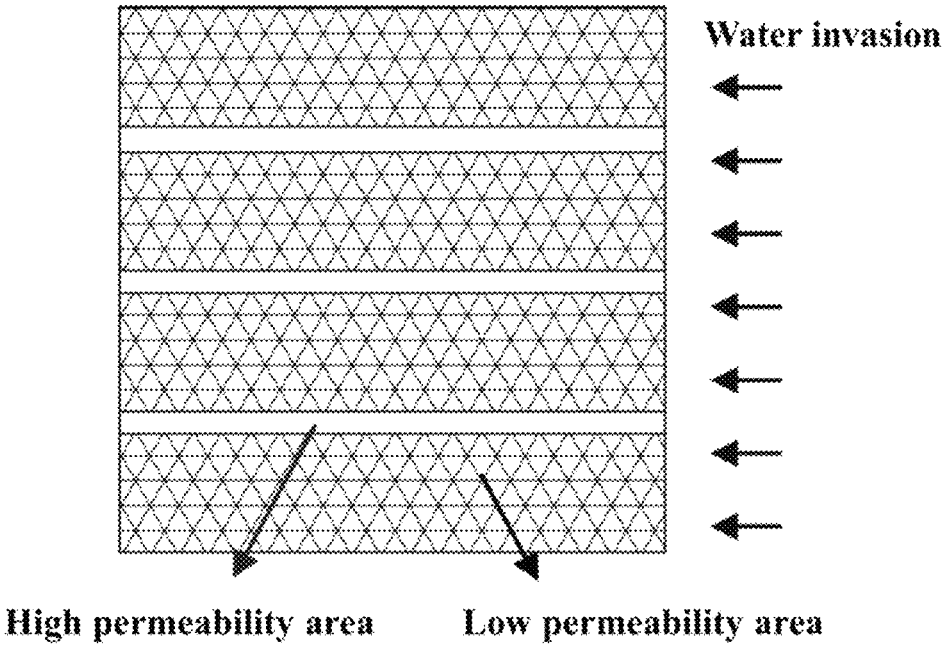
FIG. 8 is a physical model of water-gas reservoirs considering water-sealed gas phenomenon.

Referring to FIG. 1, an intelligent water invasion tracking and early warning method for water-gas reservoirs according to a preferred embodiment of the present invention is illustrated. The method comprises steps of:

(A) deriving a material balance equation which considers water-sealed gas phenomenon, which comprises:

(A1) establishing a physical model of the water-gas reservoirs which considers the water-sealed gas phenomenon, as shown in FIG. 8;

(A2) calculating an invasive water quantity in a high permeability area, an invasive water quantity in a low permeability area, a total invasive water quantity, a sealing water quantity, and a sealed gas volume respectively by formulas (1) to (5) of $$W_H = \frac{A_H K_H}{\mu}\frac{\Delta p}{\Delta L} \tag{1}$$

$$W_L = \frac{A_L K_L}{\mu}\frac{\Delta p}{\Delta L} \tag{2}$$

$$W_e = \omega G B_{gi} = R^B G B_{gi} \tag{3}$$

$$W_b = W_e \frac{W_H}{W_H + W_L} = W_e \frac{V^+ K^+}{V^+ K^+ + 1} \tag{4}$$

$$G_b = \frac{W_b}{V^+ B_{gi}} = W_e \frac{V^+ K^+}{V^+ B_{gi}(V^+ K^+ + 1)}, \tag{5}$$

wherein $W_H$ is the invasive water quantity in the high permeability area, $A_H$ is cross-sectional area of the high permeability area, $K_H$ is permeability of the high permeability area, μ is gas viscosity, Δp/ΔL is pressure drop per unit length, $W_L$ is the invasive water quantity in the low permeability area, $A_L$ is cross-sectional area of the low permeability area, $K_L$ is permeability of the low permeability area, $W_e$ is the total invasive water quantity, ω is storativity ratio, G is single well controlled reserves, $B_{gi}$ is original gas volume coefficient, R is recovery percent of reserves, B is water invasion constant, $W_b$ is sealing water quantity, $V^+$ is dimensionless volume ratio, $K^+$ is dimensionless permeability ratio, $G_b$ is sealed gas volume; and (A3) substituting the formulas (1) to (5) in the step (A2) into a material balance equation expressed by a formula (6) to obtain the material balance equation considering the water-sealed gas phenomenon expressed by a formula (7), wherein the formulas (6) and (7) are respectively $$GB_{gi} = (G - G_p - G_b)B_g + W_e \tag{6}$$

$$\frac{p/Z}{p_i/Z_i} = \frac{1 - R - AR^B}{1 - R^B}, \tag{7}$$

wherein $$B_{gi} = p_{sc} Z_i T / p_i T_{sc}, \quad B_g = p_{sc} Z T / p T_{sc}, \quad R = G_p / G,$$

$$A = \left(\frac{V^+ K^+}{V^+ K^+ + 1}\right)\frac{1}{V^+}, \quad V^+ = \frac{V_H}{V_L}, \quad K^+ = \frac{K_H}{K_L},$$

here, $G_p$ is cumulative gas production, $B_g$ is gas volume coefficient, Z is deviation factor, $Z_i$ is original deviation factor, p is formation pressure, $p_i$ is original formation pressure, A is reservoir heterogeneity coefficient, $p_{sc}$ is standard pressure and equal to 0.1013 MPa, $T_{sc}$ is standard temperature and equal to 293.15 K, T is temperature;

(B) based on the material balance equation considering the water-sealed gas phenomenon and a gas well productivity equation, fitting by automatic fitting method, wherein the gas well productivity equation is $p^2 - p_{wf}^2 = Cq_{sc} + Dq_{sc}^2$, here, p is formation pressure, $p_{wf}$ is flowing bottomhole pressure, $q_{sc}$ is gas well production per day, C is laminar coefficient, D is turbulent coefficient, target parameters of the fitting are the reservoir heterogeneity coefficient A, the water invasion constant B, the laminar coefficient C, the turbulent coefficient D and the single well controlled reserves G, the fitting comprises:

(B1) calculating the flowing bottomhole pressure $p_{wf}$ through a wellhead pressure of a production gas well;

(B2) providing upper and lower limits of the target parameters, randomly selecting an initial value within the upper and lower limits, expanding a range defined by the upper and lower limits if a calculation result corresponding to the initial value is out of the range by assigning the calculation result to the upper and lower limits, recalculating till the convergence conditions are met, and calculating the gas well production per day $q_{sc}$ based on the formation pressure p, the flowing bottomhole pressure $p_{wf}$, an initial value of the laminar coefficient C and an initial value of the turbulent coefficient D by the gas well productivity equation;

(B3) obtaining the cumulative gas production $G_p$ by superimposing the gas well production per day $q_{sc}$, and calculating a formation pressure p for a next iteration cycle based on the cumulative gas production $G_p$, an initial formation pressure, an initial value of the reservoir heterogeneity coefficient A, an initial value of the water invasion constant B and an initial value of the single well controlled reserves G by the material balance equation considering the water-sealed gas phenomenon; and (B4) continuing iteration from the step (B1) through the formation pressure p obtained by the step (B3), wherein one day in production data is an iteration cycle, obtaining the flowing bottomhole pressure, water production and the water invasion constant B during an entire production stage, adjusting parameters in the upper and lower limits, fitting the flowing bottomhole pressure and the water production by automatic fitting method, finding a best fitting between an optimal theoretical value and an actual value of the lowing bottomhole pressure and the water production, where in a convergence condition for water production fitting is expressed by a formula of $$E = \sum_{i=1} [q_{wei}(A, B, C, D, G) - q_{wei}]^2 \le 0.0001, \tag{8}$$

here, E is deviation, $q_{wci}$ (A, B, C, D, G) is the optimal theoretical value of the water production, $q_{wci}$ is the actual value of the water production; and (C) converting the water invasion constant into a water flooding index by a formula of $$I_w = \frac{(G_p/G)^B G B_g + W_p B_w}{G_p B_g + W_p B_w}, \tag{9}$$

where in $I_w$ is the water flooding index, $W_p$ is cumulative water production;

revising a water invasion classification boundary, and then dividing a block into a non-water invasion area, a weak water invasion area and a strong water invasion area according to a revised water flooding index interval; and based on the non-water invasion area, the weak water invasion area and the strong water invasion area, performing a water invasion degree judgment on the water flooding index, thereby achieving tracking and early warning water invasion, wherein FIG. 4 is a water invasion tracking map of a certain block in 2010, FIG. 5 is a water invasion tracking map of a certain block in 2020, FIG. 6 is a water invasion tracking map of a certain block in 2030, FIG. 7 is a water invasion tracking map of a certain block in 2040, small circles in FIGS. 4 to 7 are water production gas well.

Preferably, the step (B1) of calculating the flowing bottomhole pressure through the wellhead pressure of the production gas well is to calculate the flowing bottomhole pressure through an actual gas production, an actual water production and an actual wellhead oil pressure of a gas well, wherein when a ratio of the actual gas production to the actual water production is larger than $10\times10^4$, the flowing bottomhole pressure is calculated by a quasi-single-phase wellbore flow model, when the ratio is smaller than or equal to $10\times10^4$, the flowing bottomhole pressure is calculated by a two-phase wellbore flow model.

Preferably, in the step (C), the non-water invasion area means the water flooding index is in a range of 0 to 0.05, the weak water invasion area means the water flooding index is in a range of 0.05 to 0.3, and a strong water invasion area means the water flooding index is in a range of 0.3 to 1.0.

Compared with prior arts, the present invention has some beneficial effects as follows.

(1) Because the automatic fitting method is used for fitting, the fitting effect of the present invention is better.

(2) The present invention realizes water invasion tracking and early warning through programming, saving time and effort.

(3) The present invention has strong generalizability.

Finally, it should be noted that the above embodiment is only used to illustrate rather than limit the technical solutions of the present invention. Although the present invention has been described in detail with reference to the above embodiment, those skilled in the art should understand that the present invention is still able to be modified or equivalently replaced. Any modification or partial replacement that does not depart from the spirit and scope of the present invention shall be covered by the scope of the claims of the present invention.

What is claimed is:

1. An intelligent water invasion tracking and early warning method for water-gas reservoirs, the method comprising steps of:

(A) deriving a material balance equation which considers water-sealed gas phenomenon, which comprises:

(A1) establishing a physical model of the water-gas reservoirs which considers the water-sealed gas phenomenon;

(A2) calculating an invasive water quantity in a high permeability area, an invasive water quantity in a low permeability area, a total invasive water quantity, a sealing water quantity, and a sealed gas volume respectively by formulas (1) to (5) of $$W_H = \frac{A_H K_H}{\mu}\frac{\Delta p}{\Delta L} \tag{1}$$

$$W_L = \frac{A_L K_L}{\mu}\frac{\Delta p}{\Delta L} \tag{2}$$

-continued $$W_e = \omega G B_{gi} = R^B G B_{gi} \tag{3}$$

$$W_b = W_e \frac{W_H}{W_H + W_L} = W_e \frac{V^+K^+}{V^+K^+ + 1} \tag{4}$$

$$G_b = \frac{W_b}{V^+ B_{gi}} = W_e \frac{V^+K^+}{V^+ B_{gi}(V^+K^+ + 1)}, \tag{5}$$

wherein $W_H$ is the invasive water quantity in the high permeability area, $A_H$ is cross-sectional area of the high permeability area, $K_H$ is permeability of the high permeability area, μ is gas viscosity, Δp/ΔL is pressure drop per unit length, $W_L$ is the invasive water quantity in the low permeability area, $A_L$ is cross-sectional area of the low permeability area, $K_L$ is permeability of the low permeability area, $W_e$ is the total invasive water quantity, ω is storativity ratio, G is single well controlled reserves, $B_{gi}$ is original gas volume coefficient, R is recovery percent of reserves, B is water invasion constant, $W_b$ is sealing water quantity, $V^+$ is dimensionless volume ratio, $K^+$ is dimensionless permeability ratio, $G_b$ is sealed gas volume; and (A3) substituting the formulas (1) to (5) in the step (A2) into a material balance equation expressed by a formula (6) to obtain the material balance equation considering the water-sealed gas phenomenon expressed by a formula (7), wherein the formulas (6) and (7) are respectively $$GB_{gi} = (G - G_p - G_b)B_g + W_e \tag{6}$$

$$\frac{p/Z}{p_i/Z_i} = \frac{1 - R - AR^B}{1 - R^B}, \tag{7}$$

wherein $$B_{gi} = p_{sc}Z_iT/p_iT_{sc},\quad B_g = p_{sc}ZT/pT_{sc},\quad R = G_p/G,$$

$$A = \left(\frac{V^+K^+}{V^+K^+ + 1}\right)\frac{1}{V^+},\quad V^+ = \frac{V_H}{V_L},\quad K^+ = \frac{K_H}{K_L},$$

here, $G_p$ is cumulative gas production, $B_g$ is gas volume coefficient, Z is deviation factor, $Z_i$ is original deviation factor, p is formation pressure, $p_i$ is original formation pressure, A is reservoir heterogeneity coefficient, $p_{sc}$ is standard pressure and equal to 0.1013 MPa, $T_{sc}$ is standard temperature and equal to 293.15 K, T is temperature;

(B) based on the material balance equation considering the water-sealed gas phenomenon and a gas well productivity equation, fitting by automatic fitting method, wherein the gas well productivity equation is $p^2-p_{wf}^2=Cq_{sc}+Dq_{sc}^2$, here, p is formation pressure, $p_{wf}$ is flowing bottomhole pressure, $q_{sc}$ is gas well production per day, C is laminar coefficient, D is turbulent coefficient, target parameters of the fitting are the reservoir heterogeneity coefficient A, the water invasion constant B, the laminar coefficient C, the turbulent coefficient D and the single well controlled reserves G, the fitting comprises:

(B1) calculating the flowing bottomhole pressure $p_{wf}$ through a wellhead pressure of a production gas well;

(B2) providing upper and lower limits of the target parameters, randomly selecting an initial value within the upper and lower limits, expanding a range defined by the upper and lower limits if a calculation result corresponding to the initial value is out of the range by assigning the calculation result to the upper and lower limits, recalculating till the convergence conditions are met, and calculating the gas well production per day $q_{sc}$ based on the formation pressure p, the flowing bottomhole pressure $p_{wf}$, an initial value of the laminar coefficient C and an initial value of the turbulent coefficient D by the gas well productivity equation;

(B3) obtaining the cumulative gas production $G_p$ by superimposing the gas well production per day $q_{sc}$, and calculating a formation pressure p for a next iteration cycle based on the cumulative gas production $G_p$, an initial formation pressure, an initial value of the reservoir heterogeneity coefficient A, an initial value of the water invasion constant B and an initial value of the single well controlled reserves G by the material balance equation considering the water-sealed gas phenomenon; and (B4) continuing iteration from the step (B1) through the formation pressure p obtained by the step (B3), wherein one day in production data is an iteration cycle, obtaining the flowing bottomhole pressure, water production and the water invasion constant B during an entire production stage, adjusting parameters in the upper and lower limits, fitting the flowing bottomhole pressure and the water production by automatic fitting method, finding a best fitting between an optimal theoretical value and an actual value of the lowing bottomhole pressure and the water production, wherein a convergence condition for water production fitting is expressed by a formula of $$E = \sum_{i=1} [q_{wei}(A, B, C, D, G) - q_{wei}]^2 \leq 0.0001, \tag{8}$$

here, E is deviation, $q_{wci}$ (A, B, C, D, G) is the optimal theoretical value of the water production, $q_{wci}$ is the actual value of the water production; and (C) converting the water invasion constant into a water flooding index by a formula of $$I_w = \frac{(G_p/G)^B G B_g + W_p B_w}{G_p B_g + W_p B_w}, \tag{9}$$

wherein $I_w$ is the water flooding index, $W_p$ is cumulative water production;

revising a water invasion classification boundary, and then dividing a block into a non-water invasion area, a weak water invasion area and a strong water invasion area according to a revised water flooding index interval; and based on the non-water invasion area, the weak water invasion area and the strong water invasion area, performing a water invasion degree judgment on the water flooding index, thereby achieving tracking and early warning water invasion.

2. The intelligent water invasion tracking and early warning method according to claim 1, wherein in the step (C), the non-water invasion area means the water flooding index is in a range of 0 to 0.05, the weak water invasion area means the water flooding index is in a range of 0.05 to 0.3, and a strong water invasion area means the water flooding index is in a range of 0.3 to 1.0.

* * * * *